US009993676B2

(12) United States Patent
Guillot

(10) Patent No.: US 9,993,676 B2
(45) Date of Patent: Jun. 12, 2018

(54) REBOUNDER ASSEMBLY HAVING AN ADJUSTABLE TENSION BED

(71) Applicant: ACTIVE FUN COMPANY LIMITED, Hong Kong (CN)

(72) Inventor: Cyrille Guillot, Queenstown (NZ)

(73) Assignee: ACTIVE FUN COMPANY LIMITED (CN)

( * ) Notice: Subject to any disclaimer, the term of this patent is extended or adjusted under 35 U.S.C. 154(b) by 0 days. days.

(21) Appl. No.: 15/535,608

(22) PCT Filed: Jan. 18, 2016

(86) PCT No.: PCT/IB2016/050233

§ 371 (c)(1),
(2) Date: Jun. 13, 2017

(87) PCT Pub. No.: WO2016/116847

PCT Pub. Date: Jul. 28, 2016

(65) Prior Publication Data

US 2017/0368397 A1 Dec. 28, 2017

Related U.S. Application Data

(60) Provisional application No. 62/105,310, filed on Jan. 20, 2015.

(51) Int. Cl.
*A63B 5/11* (2006.01)
*A63B 21/055* (2006.01)

(52) U.S. Cl.
CPC ..... *A63B 5/11* (2013.01); *A63B 21/055* (2013.01)

(58) Field of Classification Search
CPC ..... A63B 5/11; A63B 21/055
(Continued)

(56) References Cited

U.S. PATENT DOCUMENTS 3,869,120 A * 3/1975 Nissen ..... A63B 5/11 482/27
4,139,192 A * 2/1979 McNeil ..... A63B 5/11 403/293

(Continued)

FOREIGN PATENT DOCUMENTS

CN CN203694495 U 7/2014
CN CN203724684 U 7/2014

(Continued)

OTHER PUBLICATIONS

International Search Report and Written Opinion, issued by the State Intellectual Property Office of the P.R. China as ISA, for PCT/IB2016/050233, dated Jun. 6, 2016.

*Primary Examiner* — Andrew S Lo
(74) *Attorney, Agent, or Firm* — Roeder & Broder LLP; Steven G. Roeder

(57) ABSTRACT

A rebounder assembly (10) includes a rebounder bed (12), a rebounder frame (14), and a plurality of spaced apart rebounder connectors (15) that connect the rebounder bed (12) to the rebounder frame (14) in tension. At least one of the rebounder connectors (15) includes a resilient member (16) and a rebounder fastener (18). The rebounder fastener (18) includes an outer frame (224) that defines a portion of a first retaining area (220) and a first cantilevering arm (226) that extends away from the outer frame (224), the first cantilevering arm (226) defining at least a portion of a second retaining area (222). The resilient member (16) is selectively movable relative to the rebounder fastener (18) between a first position where the resilient member (16) engages the first retaining area (220), and a second position where the resilient member (16) engages the second retaining area (222) to selectively adjust the tension of the rebounder bed (12).

20 Claims, 7 Drawing Sheets

(58) Field of Classification Search
USPC ..... 482/27
See application file for complete search history.

(56) References Cited

U.S. PATENT DOCUMENTS

| | | | | |
|---|---|---|---|---|
| 4,162,063 | A | 7/1979 | Nissen et al. | |
| 4,452,444 | A | 6/1984 | Schulze | |
| 6,110,074 | A * | 8/2000 | Tacquet | A63B 5/11 482/27 |
| 2003/0036460 | A1* | 2/2003 | Publicover | A63B 5/11 482/27 |
| 2005/0037896 | A1 | 2/2005 | Publicover | |
| 2006/0116242 | A1* | 6/2006 | Publicover | A63B 5/11 482/27 |
| 2007/0142180 | A1* | 6/2007 | Publicover | A63B 5/11 482/27 |
| 2009/0258760 | A1 | 10/2009 | Plante et al. | |
| 2010/0009812 | A1* | 1/2010 | Pieper Genannt Schmauck | A63B 5/11 482/27 |
| 2010/0075810 | A1* | 3/2010 | Schaffer | A63B 5/11 482/27 |
| 2012/0172179 | A1 | 7/2012 | Crawford | |
| 2013/0316876 | A1 | 11/2013 | Publicover | |
| 2016/0296782 | A1* | 10/2016 | Dai | A63B 5/11 |
| 2017/0050064 | A1 | 2/2017 | Ikegami | |

FOREIGN PATENT DOCUMENTS

| | | | |
|---|---|---|---|
| DE | DE2701446 | A1 | 7/1977 |
| WO | WO2006055885 | A1 | 5/2006 |
| WO | WO2015170181 | | 1/2016 |

* cited by examiner

REBOUNDER ASSEMBLY HAVING AN ADJUSTABLE TENSION BED

RELATED APPLICATION

This application claims priority on U.S. Provisional Application Ser. No. 62/105,310, filed Jan. 20, 2015 and entitled "REBOUNDER ASSEMBLY HAVING AN ADJUSTABLE TENSION BED". As far as permitted, the contents of U.S. Provisional Application Ser. No. 62/105,310 are incorporated herein by reference.

BACKGROUND

Rebounders can be used for recreation and for other purposes. A rebounder assembly typically includes a rebounder bed, a rebounder frame, and a rebounder connector assembly, e.g., springs, that connects the rebounder bed to the rebounder frame.

Some rebounder users may wish to have a harder bounce which is produced by a higher tension on the rebounder bed. Alternatively, other rebounder users may wish to have a softer bounce which is produced by a lower tension on the rebounder bed. Currently, it is not easy to adjust the tension of the rebounder bed as such tension adjustment typically necessitates that the springs be replaced.

SUMMARY

The present invention is directed toward a rebounder assembly including a rebounder bed, a rebounder frame, and a plurality of spaced apart rebounder connectors that connect the rebounder bed to the rebounder frame in tension. In various embodiments, at least one of the rebounder connectors includes a resilient member and a rebounder fastener that connect and/or extend between the rebounder bed and the rebounder frame. The rebounder fastener includes an outer frame that defines at least a portion of a first retaining area and a first cantilevering arm that extends away from the outer frame, e.g., inwardly into an interior of the outer frame, the first cantilevering arm defining at least a portion of a second retaining area. Additionally, the resilient member is selectively movable relative to the rebounder fastener between a first position where the resilient member engages the first retaining area, and a second position where the resilient member engages the second retaining area to selectively adjust the tension of the rebounder bed.

In certain embodiments, the resilient member is directly connected to the rebounder frame and the rebounder fastener is directly connected to the rebounder bed. Alternatively, the resilient member can be directly connected to the rebounder bed and the rebounder fastener is directly connected to the rebounder frame.

Additionally, each rebounder connector can include a resilient member and a rebounder fastener that extend between the rebounder bed and the rebounder frame. In such embodiments, each rebounder fastener can include an outer frame that defines at least a portion of a first retaining area and a first cantilevering arm that extends away from the outer frame, the first cantilevering arm defining at least a portion of a second retaining area. Further, each resilient member can be selectively movable relative to its corresponding rebounder fastener between a first position where the resilient member engages the first retaining area, and a second position where the resilient member engages the second retaining area to selectively adjust the tension of the rebounder bed. Still further, for each rebounder connector, the resilient member can be directly connected to the rebounder frame and the rebounder fastener can be directly connected to the rebounder bed.

As a result thereof, the plurality of adjustable rebounder connectors can be adjusted to provide higher bed tension and a resulting harder bounce. Further, the plurality of adjustable rebounder connectors can be adjusted to provide lower bed tension and a resulting softer bounce.

In some embodiments, the rebounder fastener is substantially triangle-shaped. In such embodiments, the rebounder fastener can include a frame base that engages the rebounder bed, and a side edge that is opposed to the frame base. The side edge can define at least a portion of the first retaining area. In certain such embodiments, the second retaining area is positioned closer to the frame base than the first retaining area.

Additionally, the rebounder bed can include a bed loop, and the frame base can be positioned substantially within the bed loop to connect the rebounder fastener to the rebounder bed. In some embodiments, the frame base is fixedly secured within the bed loop. Alternatively, in other embodiments, the frame base is removably secured within the bed loop.

As provided herein, in certain embodiments, the resilient member can be selectively moved between the first position and the second position without disconnecting the at least one rebounder connector from the rebounder bed and the rebounder frame.

To facilitate the connections of the resilient member, in some embodiments, the resilient member includes a frame end that is directly connected to the rebounder frame, and a fastener end that is selectively connected to the rebounder fastener at one of the first position and the second position.

Additionally, in certain embodiments, the rebounder fastener further includes a second cantilevering arm that extends away from the outer frame, the second cantilevering arm defining at least a portion of a third retaining area. In such embodiments, the resilient member can be selectively movable relative to the rebounder fastener between the first position where the resilient member engages the first retaining area, the second position where the resilient member engages the second retaining area, and a third position where the resilient member engages the third retaining area to selectively adjust the tension of the rebounder bed.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Embodiments of the present invention are described herein in the context of a rebounder assembly. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1A:
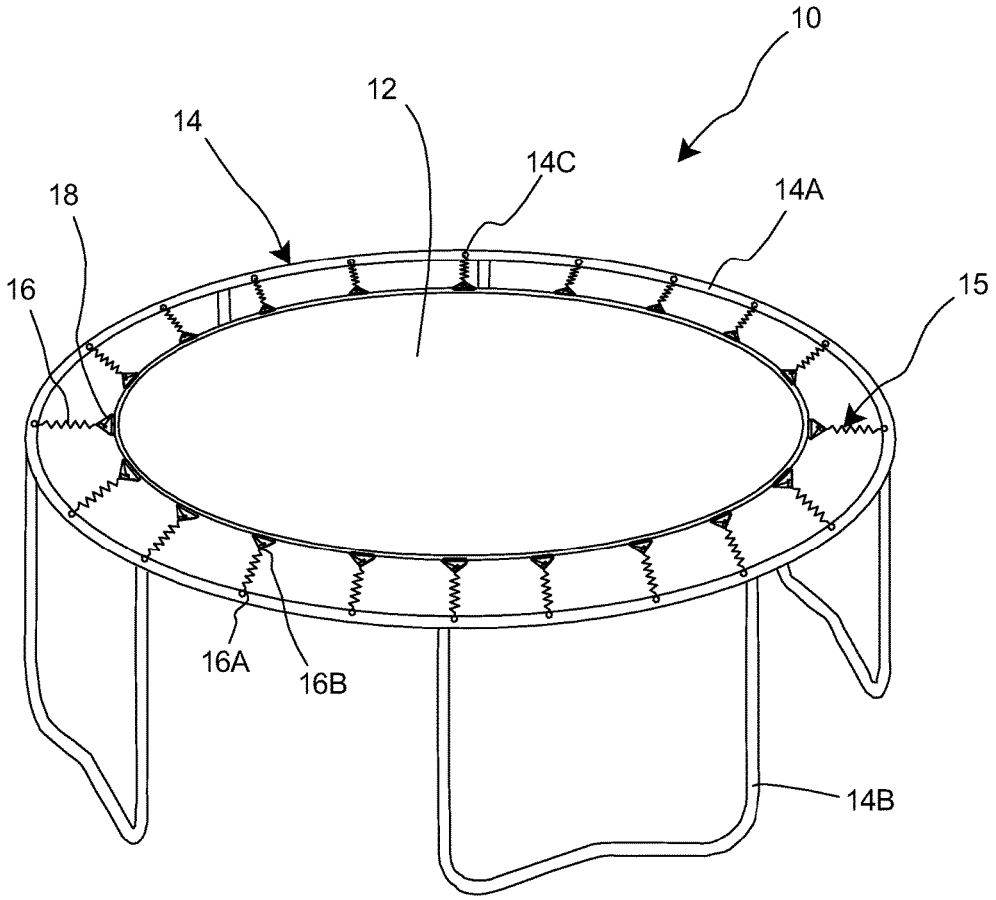
FIG. 1A is a top perspective view of an embodiment of a rebounder assembly having features of the present invention, the rebounder assembly including a rebounder bed, a rebounder frame, and a plurality of rebounder connectors that are in a first position.

FIG. 1A is a top perspective view of an embodiment of a rebounder assembly 10 having features of the present invention. The design of the rebounder assembly 10 can be varied. In certain embodiments, as shown in FIG. 1A, the rebounder assembly 10 includes a rebounder bed 12, a rebounder frame 14, and a plurality of spaced apart, radially extending, rebounder connectors 15, with each rebounder connector 15 including a resilient member 16, and a rebounder fastener 18. The design of these components can be varied to suit the desired usage of the rebounder assembly 10. In one non-exclusive embodiment, each resilient member 16 is a spring.

As an overview, in various embodiments, one or more of the rebounder connectors 15 can be selectively adjusted to selectively adjust the tension in the rebounder bed 12 to achieve the desired tension. More specifically, the relative position between the resilient member 16 and the rebounder fastener 18 in one or more of the rebounder connectors 15 can be selectively adjusted to at least two alternative positions so as to selectively adjust the tension in the rebounder bed 12 to achieve the desired tension. In certain embodiments, the resilient member 16 can be alternatively positioned in two alternative positions, i.e. a first position and a second position, relative to the rebounder fastener 18 to enable two alternative tensions, e.g., a high tension and a low tension, in the rebounder bed 12. Alternatively, in other embodiments, the resilient member 16 can be alternatively positioned in three alternative positions, i.e. a first position, a second position and a third position, relative to the rebounder fastener 18 to enable three alternative tensions, e.g., a high tension, a medium tension and a low tension, in the rebounder bed 12. Still alternatively, in still other embodiments, the resilient member 16 can be alternatively positioned in more than three alternative positions relative to the rebounder fastener 18 to enable even more tension alternatives. Moreover, it should be appreciated that by adjusting different numbers of the rebounder connectors, i.e. from between one and all of the rebounder connectors 15, the overall tension in the rebounder bed 12 can be adjusted even more precisely to suit the desires of the user.

Additionally, as provided herein, the ease of adjustment of the rebounder connector 15 is greatly enhanced as the rebounder connector 15 can be selectively adjusted while connected to the rebounder bed 12 and the rebounder frame 14 to selectively adjust the tension of the rebounder bed 12. As a result thereof, the rebounder connectors 15 can be selectively adjusted to provide the desired bounce (desired tension) of the rebounder bed 12. Further, with the design of the rebounder connector 15 as described in detail herein, the rebounder connector 15 can be individually adjusted without removal and/or replacement of the resilient member 16.

Still further, as described herein, in various embodiments, the adjustability of the rebounder connector 15 occurs within the connection between the rebounder connector 15 and the rebounder bed 12, i.e. on the bed-side, as the rebounder connectors 15 are fixedly and/or directly connected to the rebounder frame 14. Stated in another manner, in such embodiments, the adjustments in tension with the rebounder connectors 15 must be made within the bed-side connection as there is no adjustability within the frame-side connection. Stated in still another manner, the resilient member 16 is adjustably connected to the rebounder fastener 18 adjacent to the rebounder bed 12 in one of the alternative positions to selective adjust to different tensions in the rebounder bed 12.

The rebounder bed 12 provides a surface for the user to bounce on. The design of the rebounder bed 12 can be varied depending upon the requirements of the rebounder assembly 10 and/or the rebounder frame 14. In FIG. 1A, the rebounder bed 12 is substantially circular in shape. For example, in certain non-exclusive alternative embodiments, the rebounder bed 12 can have a diameter of approximately three, four, five, six, seven, nine, eleven, thirteen or fourteen feet. Alternatively, the rebounder bed 12 can have a diameter different than these examples. Still alternatively, the rebounder bed 12 can be substantially oval-shaped, square-shaped, rectangle-shaped, or some other shape.

Further, the rebounder bed 12 can be formed from various sturdy fabric materials that are designed to withstand the repeated impact from a person using the rebounder assembly 10. For example, the rebounder bed 12 can be formed from a mesh material or other similar material. Alternatively, the rebounder bed 12 can be formed from materials including heavy canvas, vinyl, or nylon.

The rebounder frame 14 supports the rebounder bed 12 above the ground or other support surface. The design of the rebounder frame 14 can be varied depending on the requirements of the rebounder assembly 10. In FIG. 1A, the rebounder frame 14 includes a base frame 14A and a plurality of spaced apart legs 14B that maintain the base frame 14A above the ground or other support surface. The rebounder frame 14 can be formed from various materials such as metal, wood, plastic, composite materials, ceramic, or any other suitably rigid materials. Alternatively, a combination of any of such materials can be used.

In FIG. 1A, the base frame 14A is shaped substantially like a circular tube. For example, in certain non-exclusive alternative embodiments, the base frame 14A can have a diameter of approximately four, five, six, seven, eight, ten, twelve, fourteen or fifteen feet. Alternatively, the base frame 14A can have a diameter different than these examples. Still alternatively, the base frame 14A can be substantially oval-shaped, square-shaped, rectangle-shaped, or some other shape.

The configuration of the legs 14B and the number of legs 14B can vary. For example, in the embodiment illustrated in FIG. 1A, the rebounder assembly 10 includes four legs 14B that are spaced apart around the base frame 14A. In this embodiment, each leg 14B can be somewhat U-shaped for enhanced rigidity and strength. Alternatively, the rebounder assembly 10 can be designed to have more than four or less than four legs 14B, and/or the legs 14B can have other than a U-shaped design. For example, in certain embodiments, the legs 14B can have a straight leg design.

The plurality of rebounder connectors 15 connect the rebounder bed 12 to the base frame 14A, so as to maintain the rebounder bed 12 in tension. The size and number of the rebounder connectors 15 can be varied to adjust the characteristics of the rebounder assembly 10. For example, in one embodiment, the rebounder assembly 10 can include twenty (20) rebounder connectors 15 that are equally spaced around a perimeter of the rebounder bed 12. Alternatively, the rebounder assembly 10 can be designed to include more than twenty (20) or fewer than twenty (20) rebounder connectors 15.

As provided herein, one or more of the rebounder connectors 15 can be selectively adjusted to selectively adjust the tension in the rebounder bed 12. For example, in one non-exclusive embodiment, all of the rebounder connectors 15 are adjustable and extend radially.

As illustrated in FIG. 1A, each of the plurality of rebounder connectors 15 are positioned in a first position, i.e. each of the resilient members 16 are in a first position relative to the respective rebounder fastener 18. With such configuration, the rebounder connectors 15 maintain the rebounder bed 12 in a lower tension, thus providing a softer bounce for the user.

Figure 1B:
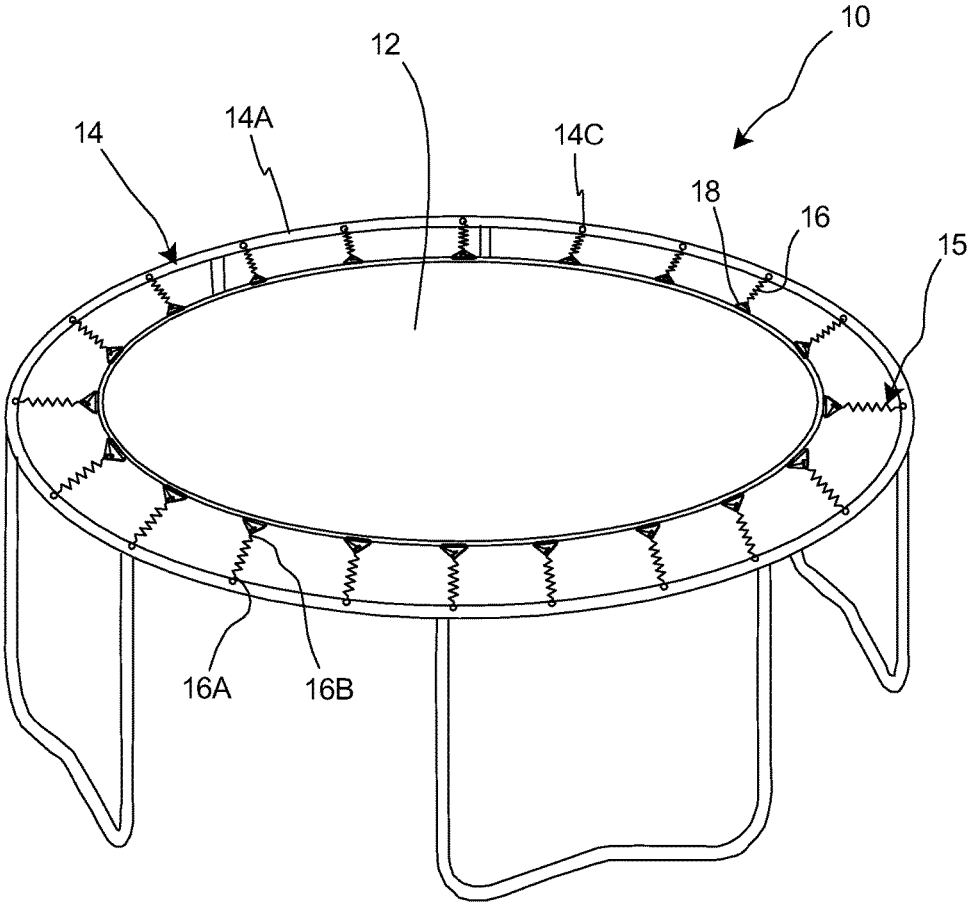
FIG. 1B is a top perspective view of the rebounder assembly in FIG. 1A, with the plurality of rebounder connectors being in a second position.

FIG. 1B is another top perspective view of the rebounder assembly 10 in FIG. 1A. More particularly, FIG. 1B again illustrates the rebounder bed 12, the rebounder frame 14 and the plurality of rebounder connectors 15 that connect the rebounder bed 12 to the rebounder frame 14 to maintain the rebounder bed 12 in tension. However, as shown in FIG. 1B, each of the plurality of rebounder connectors 15 are positioned in a second position, i.e. each of the resilient members 16 are in a second position relative to the respective rebounder fastener 18. With this configuration, the rebounder connectors 15 maintain the rebounder bed 12 in a higher tension, thus providing a harder bounce for the user.

As illustrated in FIGS. 1A and 1B, each of the resilient members 16 includes a frame end 16A and an opposed fastener end 16B. The frame end 16A is connected to the base frame 14A. For example, in certain embodiments, the frame end 16A can comprise a hook that extends into and is retained within a frame aperture 14C in the base frame 14A. Additionally, in this embodiment, the fastener end 16B can comprise a hook that is configured to alternatively engage and/or be directly connected to the respective rebounder fastener 18 in a first retaining area 220 (illustrated in FIG. 2) that coincides with the first position, and a second retaining area 222 (illustrated in FIG. 2) that coincides with the second position.

Figure 2:
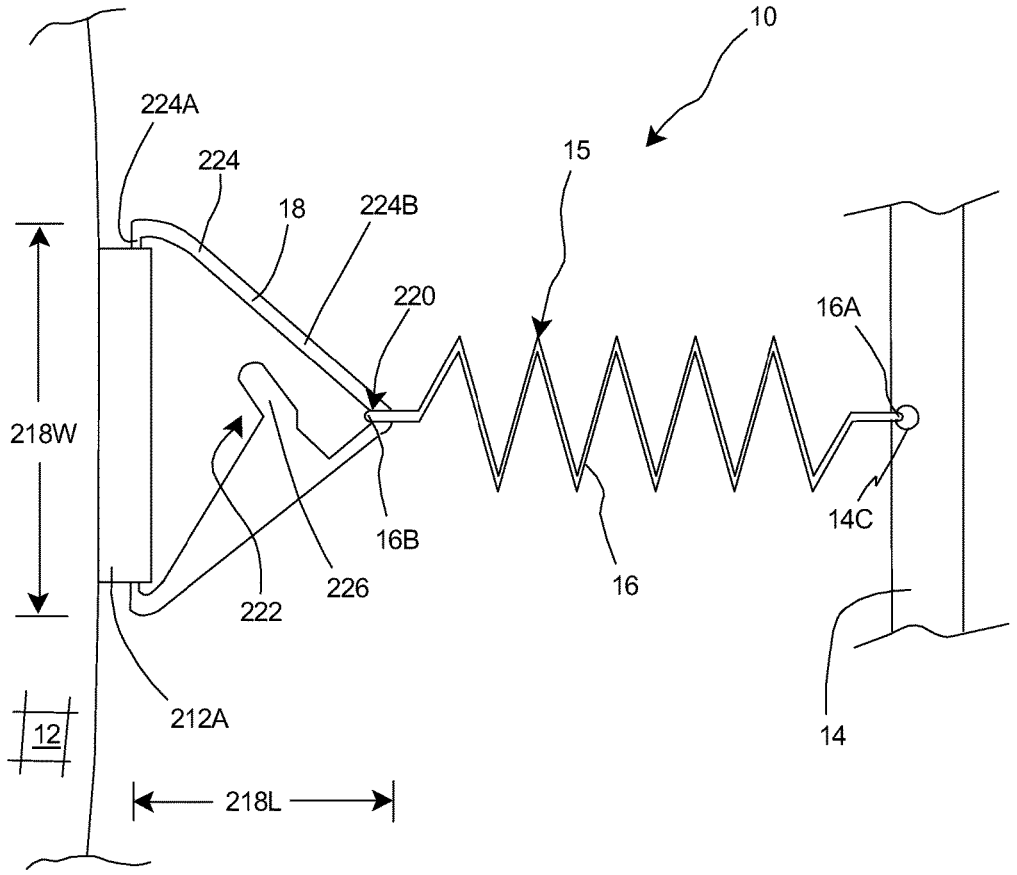
FIG. 2 is a simplified top view of a portion of the rebounder bed, a portion of the rebounder frame, and one of the rebounder connectors having features of the present invention that is connected to and extends between the rebounder bed and the rebounder frame.

FIG. 2 is a simplified top view of a portion of the rebounder bed 12, a portion of the rebounder frame 14 (i.e. a portion of the base frame 14A), and one of the rebounder connectors 15 having features of the present invention. As illustrated, the rebounder connector 15 is connected to and extends between the rebounder bed 12 and the rebounder frame 14 to help in maintaining the rebounder bed 12 in the desired tension. More particularly, the rebounder connector 15 includes the resilient member 16 having the frame end 16A that extends through the frame aperture 14C and is directly connected to the base frame 14A, and the rebounder fastener 18 that is directly connected to the rebounder bed 12. Additionally, the resilient member 16 further includes the fastener end 16B that is configured to engage the rebounder fastener 18. As noted above, the fastener end 16B of the resilient member 16 can alternatively engage the rebounder fastener 18 (i) at the first retaining area 220 that coincides with the first position (such as is shown in FIG. 2), for when a lower tension and/or a softer bounce is desired; and (ii) at the second retaining area 222 that coincides with the second position (as shown, for example, in FIG. 3B), for when a higher tension and/or a harder bounce is desired.

Additionally, as shown in FIG. 2, the rebounder bed 12 can include a separate bed loop 212A for securing each of the rebounder fasteners 18 to the rebounder bed 12. In certain embodiments, the bed loop 212A is stitched or sewn so as to be formed into the rebounder bed 12. Further, in some embodiments, the bed loop 212A and the rebounder fastener 18 can be configured such that the rebounder fastener 18 is fixedly connected to the rebounder bed 12, i.e. is not readily removable from the rebounder bed 12. Alternatively, in other embodiments, the bed loop 212A and the rebounder fastener 18 can be configured such that the rebounder fastener 18 is removably connected to the rebounder bed 12.

The rebounder fastener 18 can be formed from various materials such as metal (e.g., steel), wood, plastic, composite materials, ceramic, or any other suitably rigid materials. Alternatively, a combination of any of such materials can be used.

The design of the rebounder fastener 18 can be varied to suit the requirements of the rebounder assembly 10 and/or the rebounder connectors 15. In some embodiments, as illustrated in FIG. 2, the rebounder fastener 18 includes an outer frame 224 having a somewhat triangular shape. Additionally, in some such embodiments, the outer frame 224 can include (i) a frame base 224A (shown more clearly, for example, in FIG. 3A) that is positioned in (and is retained by) the bed loop 212A and that directly connects the rebounder fastener 18 to the rebounder bed 12; and (ii) a substantially V-shaped side edge 224B that is opposed to the frame base 224A. Further, as illustrated, the rebounder fastener 18 can include a cantilevering arm 226 that extends away from the outer frame 224. As shown in FIG. 2, in some embodiments, the cantilevering arm 226 can extend inwardly away from the outer frame 224, i.e. into an interior of the outer frame 224. Alternatively, the cantilevering arm 226 can extend outwardly away from the outer frame 224. Still alternatively, the rebounder fastener 18 can have a different design and/or a different shape (e.g., rectangular).

The size of the rebounder fastener 18 can also be varied as desired. For example, in one non-exclusive embodiment, the rebounder fastener 18 can have a width 218W of approximately forty-five (45) millimeters. Alternatively, the width 218W of the rebounder fastener 18 can be greater than forty-five (45) millimeters or less than forty-five (45) millimeters. Additionally, in one non-exclusive embodiment, the rebounder fastener 18 can have a total length 218L of approximately twenty-nine (29) millimeters. Alternatively, the total length 218L of the rebounder fastener 18 can be greater than twenty-nine (29) millimeters or less than twenty-nine (29) millimeters.

Further, as noted above, the rebounder fastener 18 includes the first retaining area 220 and the spaced apart, second retaining area 222. In this embodiment, the second retaining area 222 is positioned closer to the frame base 224A (and the bed 12) than the first retaining area 220. In one non-exclusive embodiment, the second retaining area 222 is nine millimeters (9 mm) closer to the frame base 224A than the first retaining area 220. As another non-exclusive example, the second retaining area 222 can be between approximately eight to ten millimeters (8-10 mm) closer to the frame base 224A than the first retaining area 220. Alternatively, this distance can be different than these examples.

As provided in more detail below, in the first position, the resilient member 16 engages the first retaining area 220; and in the second position, the resilient member 16 engages the second retaining area 222, which is closer to the frame base 224A and the rebounder bed 12. As a result thereof, the resilient member 16 and the rebounder bed 12 are in more tension when the resilient member 16 is retained at the second retaining area 222 than the first retaining area 220.

Figure 3A:
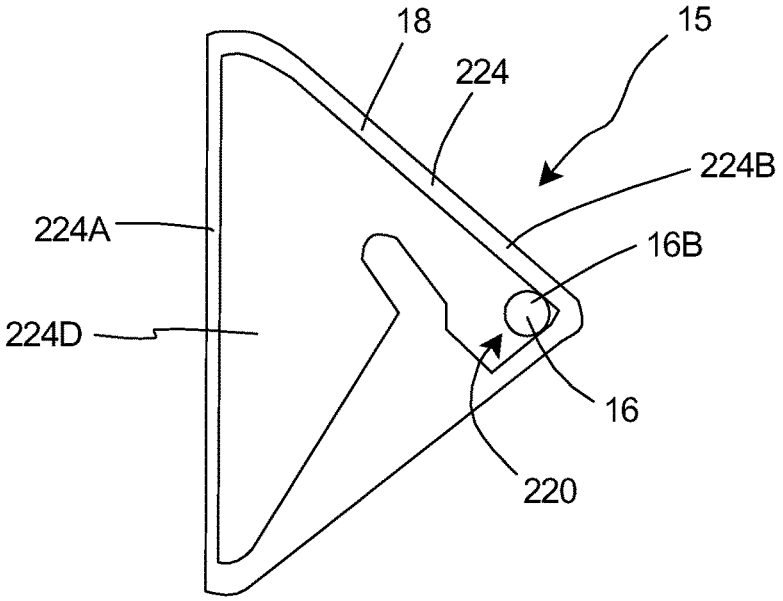
FIG. 3A is a simplified top view of a rebounder fastener that can be utilized as part of one of the rebounder connectors illustrated in FIG. 1A, and a portion of a resilient member that is coupled to the rebounder fastener in the first position.

FIG. 3A is a simplified top view of the rebounder fastener 18, and a portion of the resilient member 16 (illustrated simply as a small circle in this Figure so as to not obscure the details of the rebounder fastener 18) that is coupled to the rebounder fastener 18 in the first position, i.e. in the first retaining area 220. As provided herein, the rebounder fastener 18 and the resilient member 16 cooperate to form one of the rebounder connectors 15 of the rebounder assembly 10 illustrated in FIG. 1A.

As noted above, the rebounder fastener 18 includes the outer frame 224 that includes the frame base 224A and the substantially V-shaped side edge 224B that is opposed to the frame base 224A. In this embodiment the outer frame 224 defines an encircled area 224D that receives the fastener end 16B. In this embodiment, the encircled area 224D is somewhat triangular shaped. As shown in FIG. 3A, the inside edge of the outer frame 224 at the point of the V-shaped side edge 224B helps to define the first retaining area 220 that retains the fastener end 16B of the resilient member 16 when the resilient member 16 is in the first position. Stated in another manner, the side edge 224B of the outer frame 224 defines at least a portion of the first retaining area 220.

Figure 3B:
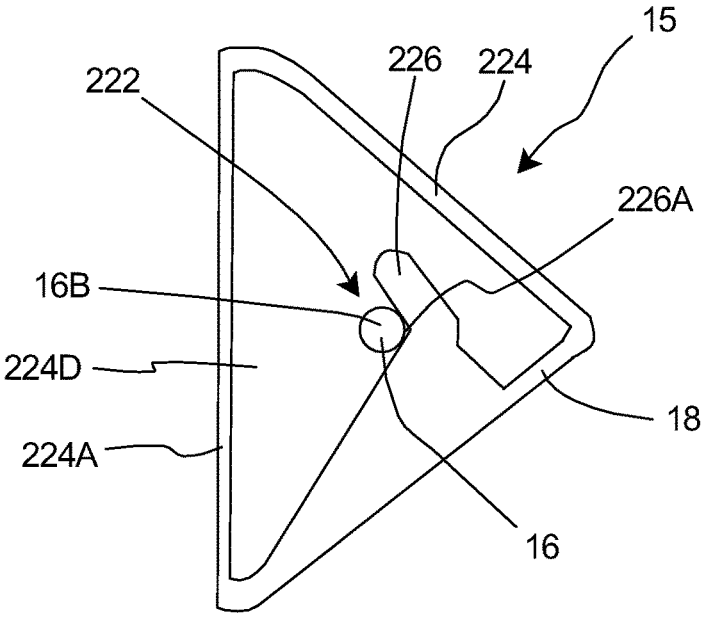
FIG. 3B is a simplified top view of the rebounder fastener in FIG. 3A, and a portion of the resilient member that is coupled to the rebounder fastener in the second position.

FIG. 3B is a simplified top view of the rebounder fastener 18, and a portion of the resilient member 16 (illustrated again as a small circle in this Figure so as to not obscure the details of the rebounder fastener 18) that is coupled to the rebounder fastener 18 in the second position, i.e. in the second retaining area 222.

As shown in FIG. 3B, the rebounder fastener 18 further includes the cantilevering arm 226 that extends away from the outer frame 224, e.g., inwardly into the interior of the outer frame 224. The design and positioning of the cantilevering arm 226 can be varied to suit the requirements of the rebounder fastener 18 and/or the resilient member 16. As illustrated, the cantilevering arm 226 can include a substantially V-shaped notch 226A that helps to define the second retaining area 222 that retains the fastener end 16B of the resilient member 16 when the resilient member 16 is in the second position. Stated in another manner, the substantially V-shaped notch 226A of the cantilevering arm 226 defines at least a portion of the second retaining area 222. In one non-exclusive embodiment, each side of the V-shaped notch 226A is angled at approximately forty-five degrees (45°) relative to the frame base 224A. Alternatively, each side of the V-shaped notch 226A can extend at a different angle relative to the frame base 224A. Still alternatively, the cantilevering arm 226 can have a different design and/or can extend away from the outer frame 224 in a different direction or a different manner.

In this embodiment, the fastener end 16B can be selectively moved back and forth between the retainer areas 220, 222 without removing the frame end 16A from the encircled area 224D of the outer frame 224, and without removing the fastener end 16B from the rebounder frame 14.

Figure 4:
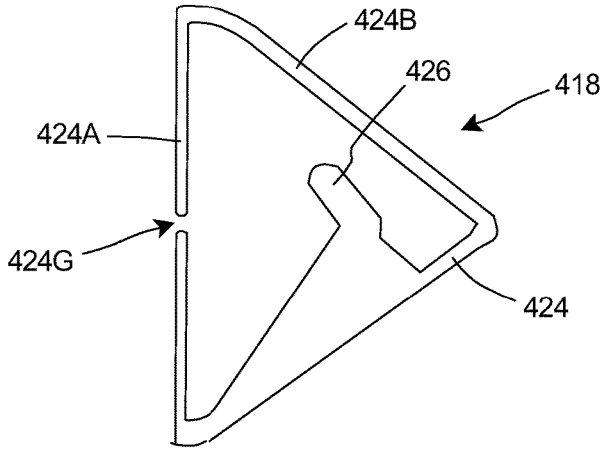
FIG. 4 is a simplified top view of another embodiment of a rebounder fastener that can be utilized as part of one of the rebounder connectors illustrated in FIG. 1A.

FIG. 4 is a simplified top view of another embodiment of a rebounder fastener 418 that can be utilized as part of one of the rebounder connectors 15 illustrated in FIG. 1A. The rebounder fastener 418 is substantially similar to the rebounder fastener 18 illustrated and described above. For example, as shown in FIG. 4, the rebounder fastener 418 includes an outer frame 424 that is substantially triangle-shaped having a frame base 424A and an opposed side edge 424B, and a cantilevering arm 426 that extends (inwardly) away from the outer frame 424. However, in this embodiment, the frame base 424A includes a gap 424G that enables the rebounder fastener 418 to be connected to and removed from the rebounder bed 12 (illustrated in FIG. 1A), i.e. from the bed loop 212A (illustrated in FIG. 2). It should be appreciated that the gap 424G is small enough and relatively centrally positioned along the frame base 424A such that a reliable connection is still maintained between the rebounder connector 15, i.e. the rebounder fastener 418, and the rebounder bed 12 during use of the rebounder assembly 10 (illustrated in FIG. 1A).

Figure 5A:
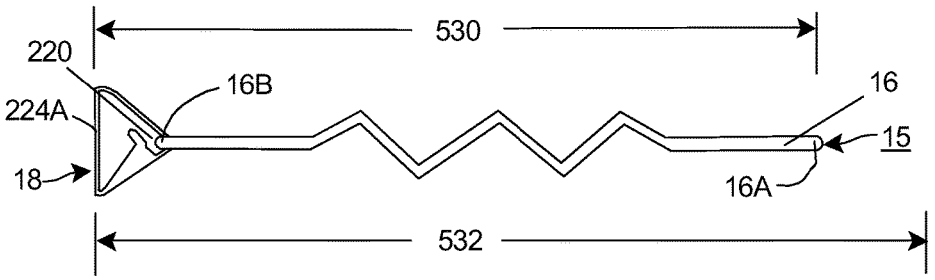
FIG. 5A is a simplified schematic illustration of a rebounder connector in the first position.
Figure 5B:
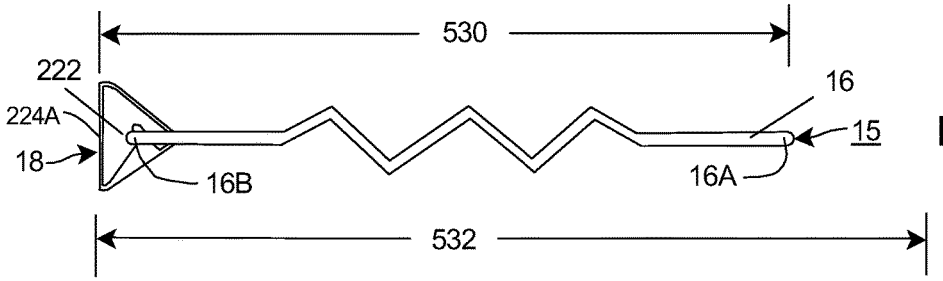
FIG. 5B is a simplified schematic illustration of the rebounder connector in the second position.

FIG. 5A is a simplified schematic illustration of the rebounder connector 15 in the first position, i.e. with the resilient member 16 positioned in the first retaining area 220 of the rebounder fastener 18. As shown, the rebounder connector 15 is in a relaxed (i.e. the resilient member 16 is not stretched) condition such as when not in use. Additionally, FIG. 5B is a simplified schematic illustration of the rebounder connector 15 in the second position, i.e. with the resilient member 16 positioned in the second retaining area 222 of the rebounder fastener 18. As shown, the rebounder connector 15 is again in a relaxed (i.e. the resilient member 16 is not stretched) condition such as when not in use.

Comparing FIGS. 5A and 5B, when in such relaxed condition, a combination length 530 of the rebounder connector 15 is longer when in the first position as compared to the second position. Stated in another manner, because the resilient member 16 is connected farther from the frame base 224A of the rebounder fastener 18 when in the first position, the relaxed resilient member 16 naturally makes the combination length 530 from the frame base 224A to the frame end 16A of the resilient member 16 somewhat longer than when in the second position. Further, as shown in FIG. 5A as in FIG. 5B, a distance 532 between the rebounder bed 12 (shown in FIG. 1A) and the rebounder frame 14 (shown in FIG. 1A) is approximately constant. Thus, for the rebounder connector 15 to connect the rebounder bed 12 to the rebounder frame 14, the resilient member 16 must be stretched.

Because the combination length 530 of the rebounder connector 15 is shorter when in the second position illustrated in FIG. 5B, the resilient member 16 must be stretched farther to connect the rebounder bed 12 to the rebounder frame 14 than when the rebounder connector 15 is in the first position illustrated in FIG. 5A. As a result thereof, the rebounder bed 12 will be in more tension in the second position than the first position. Thus, the tension in the rebounder bed 12 can be adjusted by adjusting the position of the resilient member 16 relative to the rebounder fastener 18.

Stated in another fashion, the longer combination length 530 produced when the resilient member 16 is positioned in the first retaining area 220 of the rebounder fastener 18 results in less tension on the rebounder bed 12 than when the resilient member 16 is positioned in the second retaining area 222 of the rebounder fastener 18 because the resilient member 16 is stretched less and is therefore under less tension. Similarly, the shorter combination length 530 produced when the resilient member 16 is positioned in the second retaining area 222 of the rebounder fastener 18 results in more tension on the rebounder bed 12 than when the resilient member 16 is positioned in the first retaining area 220 of the rebounder fastener 18 because the resilient member 16 is stretched more and is therefore under more tension.

Figure 5C:
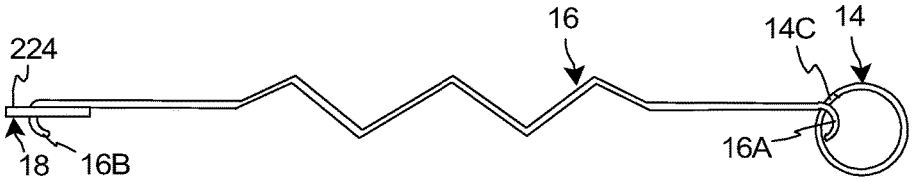
FIG. 5C is a simplified schematic illustration of the rebounder connector and a portion of the rebounder frame.

FIG. 5C is a simplified schematic illustration of the resilient member 16 extending between the rebounder frame 14 (in cut-away) and the rebounder fastener 18. As illustrated in FIG. 5C, the frame end 16A and the fastener end 16B of the resilient member 16 are hook shaped. Further, the frame end 16A extends into the frame aperture 14C of the rebounder frame 14 and the fastener end 16B extends into the outer frame 224.

It should be appreciated that the present invention enables the relatively easy adjustment of tension in the rebounder bed 12 without needing to disconnect and remove the resilient members 16 as is required in prior art rebounder assemblies. In particular, the fastener end 16B of the resilient member 16 simply needs to be moved between the first retaining area 220 and the second retaining area 222 when adjusting the tension in the rebounder bed 12 and without removing it from within the outer frame 224. Additionally, the design of the rebounder fastener 18 further enables such adjustment in tension without truly disabling the connection between the resilient member 16 and the rebounder fastener 18. For example, when moving the fastener end 16B of the resilient member 16 between the first retaining area 220 and the second retaining area 222, if the resilient member 16 slips from the control of the user, the fastener end 16B is able to simply settle into the first retaining area 220 and does not necessarily fully disconnect the resilient member 16 from the rebounder fastener 18.

Figure 6A:
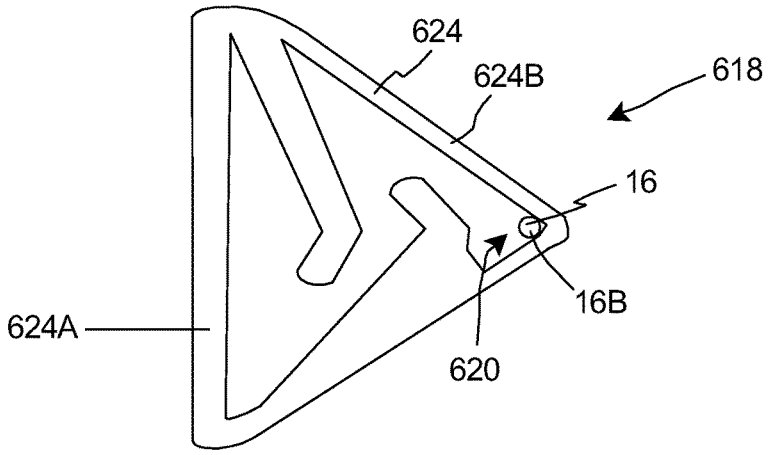
FIG. 6A is a simplified top view of still another embodiment of a rebounder fastener that can be utilized as part of one of the rebounder connectors illustrated in FIG. 1A, and a portion of the resilient member that is coupled to the rebounder fastener in a first position.

FIG. 6A is a simplified top view of still another embodiment of a rebounder fastener 618 that can be utilized as part of one of the rebounder connectors 15 illustrated in FIG. 1A. FIG. 6A further illustrates a portion of the resilient member 16 (illustrated simply as a small circle in this Figure so as to not obscure the details of the rebounder fastener 618) that is coupled to the rebounder fastener 618 in a first position, i.e. in a first retaining area 620. As illustrated, the rebounder fastener 618 and the resilient member 16 can cooperate to form one of the rebounder connectors 15 of the rebounder assembly 10 illustrated in FIG. 1A.

In this embodiment, the rebounder fastener 618 again includes an outer frame 624 that includes a frame base 624A and a substantially V-shaped side edge 624B that is opposed to the frame base 624A. As shown in FIG. 6A, the inside edge of the outer frame 624 at the point of the V-shaped side edge 624B helps to define the first retaining area 620 that retains the fastener end 16B of the resilient member 16 when the resilient member 16 is in the first position.

Figure 6B:
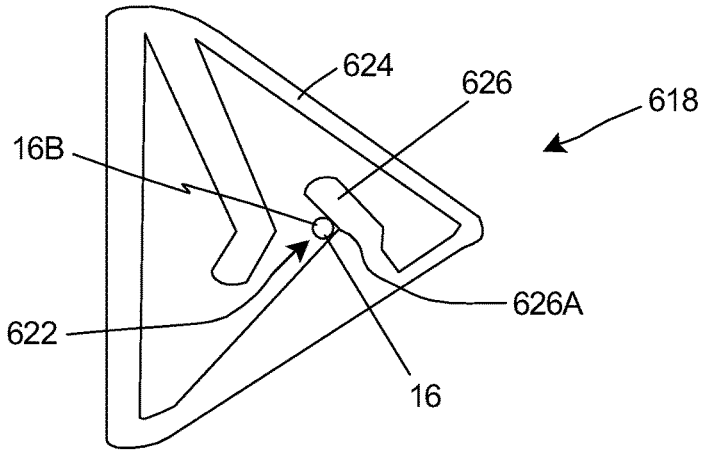
FIG. 6B is a simplified top view of the rebounder fastener in FIG. 6A, and a portion of the resilient member that is coupled to the rebounder fastener in a second position.

FIG. 6B is a simplified top view of the rebounder fastener 618 in FIG. 6A, and a portion of the resilient member 16 (illustrated again as a small circle in this Figure so as to not obscure the details of the rebounder fastener 618) that is coupled to the rebounder fastener 618 in a second position, i.e. in a second retaining area 622.

As shown in FIG. 6B, the rebounder fastener 618 further includes a first cantilevering arm 626 that extends away from the outer frame 624, e.g., inwardly into the interior of the outer frame 624. The design and positioning of the first cantilevering arm 626 are substantially similar to what was illustrated and described above regarding the cantilevering arm 226 in the previous embodiments. For example, the first cantilevering arm 626 can again include a substantially V-shaped notch 626A that helps to define the second retaining area 622 that retains the fastener end 16B of the resilient member 16 when the resilient member 16 is in the second position. Alternatively, the first cantilevering arm 626 can have a different design and/or can extend away from the outer frame 624 in a different direction or a different manner.

Figure 6C:
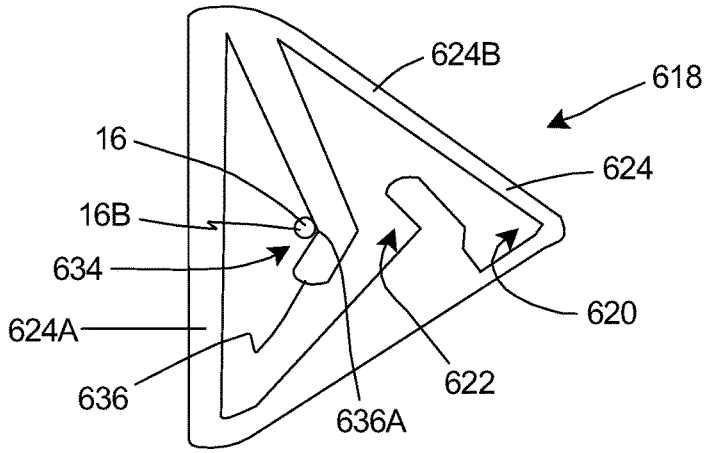
FIG. 6C is a simplified top view of the rebounder fastener in FIG. 6A, and a portion of the resilient member that is coupled to the rebounder fastener in a third position.

FIG. 6C is a simplified top view of the rebounder fastener 618 in FIG. 6A, and a portion of the resilient member 16 (illustrated yet again as a small circle in this Figure so as to not obscure the details of the rebounder fastener 618) that is coupled to the rebounder fastener in a third position, i.e. in a third retaining area 634.

As shown in FIG. 6C, the rebounder fastener 618 further includes a second cantilevering arm 636 that extends away from the outer frame 624, e.g., inwardly into the interior of the outer frame 624. The design and positioning of the second cantilevering arm 636 can be varied to suit the requirements of the rebounder fastener 618 and/or the resilient member 16. In this embodiment, the second cantilevering arm 636 extends away from the outer frame 624 on the opposite portion of the side edge 624B (i.e. the opposite leg of the V-shaped side edge 624B) as does the first cantilevering arm 626.

Additionally, as illustrated, the second cantilevering arm 636 can also include a substantially V-shaped notch 636A that helps to define the third retaining area 634 that retains the fastener end 16B of the resilient member 16 when the resilient member 16 is in the second position. In one non-exclusive embodiment, each side of the V-shaped notch 636A is angled at approximately sixty degrees (60°) relative to the frame base 624A. Alternatively, each side of the V-shaped notch 636A can extend at a different angle relative to the frame base 624A. Still alternatively, the second cantilevering arm 636 can have a different design and/or can extend away from the outer frame 624 in a different direction or a different manner.

As shown in this embodiment, the third retaining area 634 that is closer to the frame base 624A than the first retaining area 620 and the second retaining area 622.

Thus, with the rebounder fastener 618 illustrated in FIGS. 6A-6C, the resilient member 16 can engage the rebounder fastener 618 in three alternative positions, i.e. in three retaining areas 620, 622, 634. With this design, the resilient member 16 can be selectively and alternatively positioned at (i) the first position (in the first retaining area 620) that creates the lowest amount of tension on the rebounder bed 12 (illustrated in FIG. 1A), (ii) the second position (in the second retaining area 622) that creates a medium amount of tension on the rebounder bed 12, and (iii) the third position (in the third retaining area 634) that creates the highest amount of tension on the rebounder bed 12, to selectively adjust the tension of the rebounder bed.

As provided herein, the rebounder fastener 618 can be designed to include more than three alternative positions to provide more than three tensions on the rebounder bed 12.

It should be noted that in certain embodiments, all of the adjustable rebounder fasteners 18, 618 are identical and placed symmetrically and in equidistance around the rebounder bed 12 to provide a perfect balance and symmetry in the tension of the rebounder bed 12. With this design, the tension of the rebounder bed 12 can be selectively and accurately adjusted at each rebounder fastener 18, 618, without any check-up or adjustment necessary. The de-facto "pre-set" positions of the rebounder fastener 18, 618 ensure that the tension is evenly sprayed.

Figure 7A:
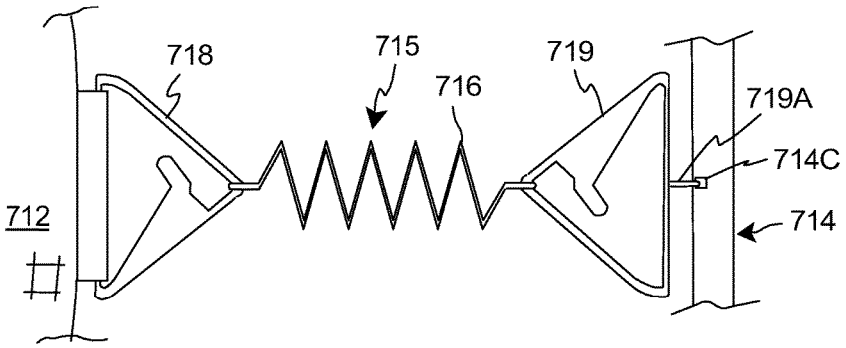
FIG. 7A is a simplified top view of a portion of the rebounder bed, a portion of the rebounder frame, and another embodiment of the rebounder connector.
Figure 7B:
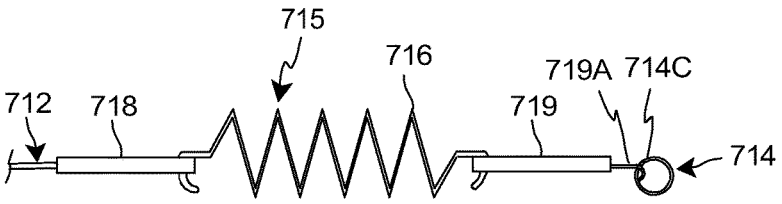
FIG. 7B is a simplified side view of FIG. 7A.

FIG. 7A is a simplified top view and FIG. 7B is a simplified side view (in cutaway) of a portion of the rebounder bed 712, a portion of the rebounder frame 714, and another embodiment of the rebounder connector 715. In this embodiment, the rebounder connector 715 includes (i) the resilient member 716, (ii) a bed rebounder fastener 718 that connects the resilient member 716 to the rebounder bed 712, and (iii) a frame rebounder fastener 719 that connects the resilient member 716 to the rebounder frame 714. With the present design, the two rebounder fasteners 718, 719 positioned on opposite ends of the resilient member 716 provide a greater range of tension adjustment. In this embodiment, the rebounder fasteners 718, 719 are similar to the rebounder fasteners 18 described above. However, in this embodiment, the frame rebounder fastener 719 can include a hook 719A or other member for attaching the frame rebounder fastener 719 to the rebounder frame 714. In this embodiment, the hook 719A fits in the frame aperture 714C of the rebounder frame 714.

Figure 8:
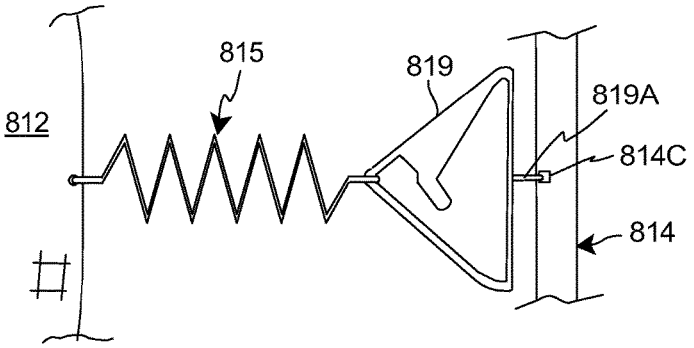
FIG. 8 is a simplified top view of a portion of the rebounder bed, a portion of the rebounder frame, and yet another embodiment of the rebounder connector.

FIG. 8 is a simplified top view of a portion of the rebounder bed 812, a portion of the rebounder frame 814, and yet another embodiment of the rebounder connector 815. In this embodiment, the rebounder connector 815 includes (i) the resilient member 816 that is connected to the rebounder bed 812, and (ii) a frame rebounder fastener 819 that connects the resilient member 816 to the rebounder frame 814. With the present design, the resilient member 816 can be moved relative to the frame rebounder fastener 819 to selectively adjust the tension of the resilient bed 812.

In this embodiment, the frame rebounder fastener 819 is similar to the rebounder fasteners 18 described above. However, in this embodiment, the frame rebounder fastener 819 includes a hook 819A or other member for attaching the frame rebounder fastener 819 to the rebounder frame 814. In this embodiment, the hook 819A fits in the frame aperture 814C of the rebounder frame 814.

It is understood that although a number of different embodiments of the rebounder assembly 10 have been illustrated and described herein, one or more features of any one embodiment can be combined with one or more features of one or more of the other embodiments, provided that such combination satisfies the intent of the present invention.

While a number of exemplary aspects and embodiments of a rebounder assembly 10 with an adjustable tension bed 12 have been shown and disclosed herein above, those of skill in the art will recognize certain modifications, permutations, additions and sub-combinations thereof. It is therefore intended that the rebounder assembly 10 with an adjustable tension bed 12 shall be interpreted to include all such modifications, permutations, additions and sub-combinations as are within their true spirit and scope, and no limitations are intended to the details of construction or design herein shown.

What is claimed is:

1. A rebounder assembly comprising:

a rebounder frame;

a rebounder bed; and a plurality of spaced apart rebounder connectors that connect the rebounder bed to the rebounder frame in tension, wherein at least one of the rebounder connectors includes a resilient member and a rebounder fastener, the rebounder fastener including an outer frame that defines at least a portion of a first retaining area and a first cantilevering arm that extends away from the outer frame, the first cantilevering arm defining at least a portion of a second retaining area; and wherein the resilient member is selectively movable relative to the rebounder fastener between a first position where the resilient member engages the first retaining area, and a second position where the resilient member engages the second retaining area to selectively adjust the tension of the rebounder bed.

2. The rebounder assembly of claim 1 wherein the resilient member is directly connected to the rebounder frame and the rebounder fastener is directly connected to the rebounder bed.

3. The rebounder assembly of claim 1 wherein each rebounder connector includes a resilient member and a rebounder fastener, each rebounder fastener including an outer frame that defines at least a portion of a first retaining area and a first cantilevering arm that extends away from the outer frame, the first cantilevering arm defining at least a portion of a second retaining area; wherein each resilient member is selectively movable relative to its corresponding rebounder fastener between a first position where the resilient member engages the first retaining area, and a second position where the resilient member engages the second retaining area to selectively adjust the tension of the rebounder bed.

4. The rebounder assembly of claim 3 wherein for each rebounder connector, the resilient member is directly connected to the rebounder frame and the rebounder fastener is directly connected to the rebounder bed.

5. The rebounder assembly of claim 1 wherein the rebounder fastener is substantially triangle-shaped, the rebounder fastener including a frame base that engages the rebounder bed, and a side edge that is opposed to the frame base; and wherein the side edge defines at least a portion of the first retaining area.

6. The rebounder assembly of claim 5 wherein the second retaining area is positioned closer to the frame base than the first retaining area.

7. The rebounder assembly of claim 5 wherein the rebounder bed includes a bed loop, and wherein the frame base is positioned substantially within the bed loop to connect the rebounder fastener to the rebounder bed.

8. The rebounder assembly of claim 7 wherein the frame base is fixedly secured within the bed loop.

9. The rebounder assembly of claim 7 wherein the frame base is removably secured within the bed loop.

10. The rebounder assembly of claim 1 wherein the resilient member can be selectively moved between the first position and the second position without disconnecting the at least one rebounder connector from the rebounder bed and the rebounder frame.

11. The rebounder assembly of claim 1 wherein the resilient member includes a frame end that is directly connected to the rebounder frame, and a fastener end that is selectively connected to the rebounder fastener at one of the first position and the second position.

12. The rebounder assembly of claim 1 wherein the first cantilevering arm extends inwardly away from the outer frame into an interior of the outer frame.

13. The rebounder assembly of claim 1 wherein the rebounder fastener further includes a second cantilevering arm that extends away from the outer frame, the second cantilevering arm defining at least a portion of a third retaining area; and wherein the resilient member is selectively movable relative to the rebounder fastener between the first position where the resilient member engages the first retaining area, the second position where the resilient member engages the second retaining area, and a third position where the resilient member engages the third retaining area to selectively adjust the tension of the rebounder bed.

14. A rebounder assembly comprising:

a rebounder frame;

a rebounder bed; and a plurality of spaced apart rebounder connectors that connect the rebounder bed to the rebounder frame in tension, wherein at least one of the rebounder connectors includes a resilient member and a rebounder fastener that extend between the rebounder bed and the rebounder frame, the resilient member being directly connected to the rebounder frame and the rebounder fastener being directly connected to the rebounder bed, the rebounder fastener including a first retaining area and a spaced apart second retaining area that are rigidly connected together; and wherein the resilient member is selectively movable relative to the rebounder fastener between a first position where the resilient member engages the first retaining area and where the rebounder bed is maintained in a first tension, and a second position where the resilient member engages the second retaining area and where the rebounder bed is maintained in a second tension that is different than the first tension.

15. The rebounder assembly of claim 14 wherein the rebounder fastener includes an outer frame that defines at least a portion of the first retaining area and a first cantilevering arm that extends away from the outer frame, the first cantilevering arm defining at least a portion of the second retaining area.

16. The rebounder assembly of claim 14 wherein each rebounder connector includes a resilient member and a rebounder fastener that extend between the rebounder bed and the rebounder frame, each resilient member being directly connected to the rebounder frame and each rebounder fastener being directly connected to the rebounder bed; and wherein each resilient member is adjustably connected to its corresponding rebounder fastener adjacent to the rebounder bed between a first position and a second position.

17. The rebounder assembly of claim 16 wherein each rebounder fastener includes an outer frame that defines at least a portion of a first retaining area and a first cantilevering arm that extends away from the outer frame, the first cantilevering arm defining at least a portion of a second retaining area; and wherein each resilient member is selectively movable relative to its corresponding rebounder fastener between the first position where the resilient member engages the first retaining area, and the second position where the resilient member engages the second retaining area to selectively adjust the tension of the rebounder bed.

18. The rebounder assembly of claim 14 wherein the rebounder fastener is substantially triangle-shaped, the rebounder fastener including a frame base that engages the rebounder bed, and a side edge that is opposed to the frame base; and wherein the side edge defines at least a portion of the first retaining area.

19. The rebounder assembly of claim 18 wherein the rebounder bed includes a bed loop, and wherein the frame base is positioned substantially within the bed loop to connect the rebounder fastener to the rebounder bed.

20. A rebounder assembly comprising:

a rebounder frame;

a rebounder bed; and a plurality of spaced apart rebounder connectors that connect the rebounder bed to the rebounder frame in tension, wherein each of the rebounder connectors includes a resilient member that is directly connected to the rebounder frame and a rebounder fastener that is directly connected to the rebounder bed, the resilient member and the rebounder fastener extending between the rebounder bed and the rebounder frame; the rebounder fastener including (i) a substantially triangle-shaped outer frame having a frame base that engages the rebounder bed and a side edge that is opposed to the frame base that defines at least a portion of a first retaining area, and (ii) a first cantilevering arm that extends inwardly away from the outer frame into an interior of the outer frame, the first cantilevering arm defining at least a portion of a second retaining area that is positioned closer to the frame base than the first retaining area; and wherein the resilient member is selectively movable relative to the rebounder fastener between a first position where the resilient member engages the first retaining area, and a second position where the resilient member engages the second retaining area to selectively adjust the tension of the rebounder bed.

* * * * *